US009289020B2

(12) United States Patent
Huang

(10) Patent No.: US 9,289,020 B2
(45) Date of Patent: Mar. 22, 2016

(54) TAILORING DEVICE AND METHODS

(71) Applicant: SiDi Huang, Oak Park, IL (US)

(72) Inventor: SiDi Huang, Oak Park, IL (US)

( * ) Notice: Subject to any disclaimer, the term of this patent is extended or adjusted under 35 U.S.C. 154(b) by 190 days.

(21) Appl. No.: 14/293,712

(22) Filed: Jun. 2, 2014

(65) Prior Publication Data

US 2015/0237941 A1 Aug. 27, 2015

Related U.S. Application Data

(60) Provisional application No. 61/945,352, filed on Feb. 27, 2014.

(51) Int. Cl.
*A41H 1/00* (2006.01)
*A41H 31/00* (2006.01)

(52) U.S. Cl.
CPC ..... *A41H 31/00* (2013.01)

(58) Field of Classification Search
CPC ..... A41H 1/00
USPC . 33/2 R, 2 H, 2 A, 8, 9 R, 11–16, 17 A, 17 R
See application file for complete search history.

(56) References Cited

U.S. PATENT DOCUMENTS 976,523 A * 11/1910 Walsh ..... A41H 9/02 33/9 R
1,616,046 A * 2/1927 Hobbs, Jr. ..... A41H 9/02 33/9 R
2,022,931 A * 12/1935 Bucci ..... A41H 9/02 33/9 R
2,509,126 A * 5/1950 Booth ..... A41H 9/02 33/9 R
2,647,316 A * 8/1953 Hughes ..... A41H 31/00 33/2 R
2,710,451 A * 6/1955 Phillips ..... A41H 9/02 33/9 R
2,892,233 A * 6/1959 Booth ..... A41H 9/02 24/328
7,322,119 B2 * 1/2008 Haug ..... G01B 5/025 33/17 R
2015/0237941 A1 * 8/2015 Huang ..... A41H 1/00 33/17 R

* cited by examiner

*Primary Examiner* — Yaritza Guadalupe-McCall

(74) *Attorney, Agent, or Firm* — Hankin Patent Law, APC; Anooj Patel; Kevin Schraven

(57) ABSTRACT

A tailoring device. The tailoring device may comprise a tube and a rod, wherein the tube may comprise a channel and one or more slits. The rod may be configured to be inserted through the channel of the tube and secured inside the tube. The slits may be used to partition the tube into one or more smaller tubes. A user may tailor a garment by inserting a measured piece of the garment into the channel of the tube and securing the measured piece of garment inside the tube by inserting the rod through the channel and into the tube while securing the garment inside the tube. The tube and rod may be removed from the garment and may be configured to reusable and easy to use.

16 Claims, 15 Drawing Sheets

TAILORING DEVICE AND METHODS

CROSS REFERENCE PARAGRAPH

This application takes priority from U.S. Provisional Patent Application No. 61/945,352, filed on Feb. 27, 2014, titled "Removable Tailoring Device", by inventor SiDi Huang, the contents of which are expressly incorporated herein by this reference as though set forth in their entirety, and to which priority is claimed.

FIELD OF THE INVENTION

The present disclosure generally relates to tailoring devices and methods thereof. In particular, the present disclosure relates to tailoring devices that are flexible, lightweight, removable, and reusable to allow users to quickly and inexpensively tailor clothing of various lengths and sizes.

BACKGROUND

Tailoring for style and fit dates back to the twelfth or thirteenth centuries when the focus of clothing shifted from concealing a person's body to accentuating human form. A tailor alters clothing by reconstructing the human body in fabric, which, before the sewing machine, required many hours of manual sewing. The advent of the sewing machine, however, vastly improved the efficiency of tailoring clothing. Thus, more garments may be tailored in a shorter period of time.

Unfortunately, despite the advantages of sewing machines, most sewing machines are relatively expensive and usually have a steep learning curve. Most people are generally unfamiliar about how to use a sewing machine and generally lack the skillset to properly tailor their own clothes. Thus, most people generally need the assistance of a tailor. Hiring a tailor, however, can become quite expensive and typically requires multiple trips to ensure a proper fitting. Additionally, a tailor may be even more expensive when garments require hand stitching, a very time-consuming task, which generally requires several days or weeks to complete the alterations.

In addition to the cost and time in tailoring, the changes made by tailored clothing are often permanent. The tailor often measures and removes excess fabric to accommodate a person's body shape or size at the time. Thus, when a person's body shape changes, the tailored clothing may have an insufficient amount of fabric for letting out or further tailoring. Furthermore, additional alterations may be done towards the tailored clothing, such alterations generally require additional time and expense.

Over the years, various tailoring devices and methods have been introduced to remedy some of the above deficiencies. For example, U.S. Patent Application Publication Number 2008/0295226, filed by Schioppa ("Schioppa"), discloses a clothes-buttoning system, where one or more buttons correspond to one or more button eyelets to help accommodate the size of the garment. While the system in the Schioppa reference allows the wearer to adjust the size of the garment by placing a button in eyelets at various locations on the garment, the Schioppa system neither has the flexibility nor the capacity to accommodate all desired garment sizes due to the predetermined and permanent locations of the buttons and eyelets. Moreover, only the part of the garment that contains the buttons and eyelets at their predetermined locations can be altered, and thus, altering the size of the garment is very limited. The additional buttons and eyelets may also be visible to a viewer, thereby making the garment less aesthetically pleasing.

U.S. Patent Application Publication Number 2013/0298313, filed by Mack ("Mack"), also discloses an undergarment attachment that allows the waistline of women's pant and skirt to be altered. The undergarment attachment in the Mack reference, however, fails to disclose a device that can alter any part of a garment. Furthermore, the undergarment attachment in the Mac reference is limited to only altering waistlines of pants and skirts for women.

Furthermore, Canadian Patent Application Publication Number CA2804342, filed by Brown et al. ("Brown"), discloses a clothing accessory that attaches to clothing by way of garter fasteners. The clothing accessory disclosed in Brown changes the appearance and fit of the clothing and allows the user to alter the clothing without having to make permanent alterations. The Brown clothing accessory, however, is very limited in its use and is overly expensive due to its ornamental and decorative nature.

Thus, what is needed is a tailoring device that allows a layperson to work quickly, inexpensively, and efficiently to non-permanently tailor an article of clothing without having any expertise in sewing. Preferably, the tailoring device is lightweight and flexible, so as to provide comfort to the wearer and to not weigh the wearer down. Additionally, the tailoring device is preferably removable and can be used or reused anywhere on the garment or on a different garment. Furthermore, the tailoring device is preferably not visible to anyone viewing the altered garment of the wearer and the garment still looks clean and attractive.

BRIEF SUMMARY OF INVENTION

To minimize the limitations in the cited references, and to minimize other limitations that will become apparent upon reading and understanding the present specification, the following discloses a new and useful tailoring device and methods.

One embodiment is a tailoring device comprising: a tube; and a rod; wherein the tube comprises a channel and a hollow portion; wherein the rod is configured to be inserted through the channel and into the hollow portion of the tube; wherein the rod has a diameter that is greater than an opening of the channel, such that the rod may be enclosed and secured by the tube; and wherein the tube is configured to accept a measured portion of a fabric past the channel and into the hollow portion of the tube and wherein the rod is configured to be put into the hollow portion of the tube over the measured portion of the fabric, such that the rod secures the measured portion of the fabric into the hollow portion of the tube. The tube may further comprise one or more slits; wherein the one or more slits may be configured to allow a user to partition the tube into one or more smaller tubes for a customized length. The tube may further comprise one or more notches; wherein the one or more notches may be configured to allow a user to partition the tube into one or more smaller tubes for a customized length. The one or more slits may be configured to reduce a weight of the tailoring device. The one or more notches may be configured to reduce a weight of the tailoring device. The tube and the rod may be flexible. The tube may be configured to releaseably secure the rod, such that the tailoring device may be reusable.

Another embodiment may be a tailoring device comprising: a tube; and a rod; wherein the tube comprises a channel and a hollow portion; wherein the rod is configured to be inserted through the channel and into the hollow portion of the tube; wherein the rod has a diameter that is greater than an opening of the channel, such that the rod may be enclosed and secured by the tube; and wherein the tube is configured to accept a measured portion of a shirt past the channel and into the hollow portion of the tube and wherein the rod is configured to be put into the hollow portion of the tube over the measured portion of the shirt, such that the rod secures the measured portion of the shirt into the hollow portion of the tube. The tube may further comprise one or more slits; wherein the one or more slits may be configured to allow a user to partition the tube into one or more smaller tubes for a customized length. The tube may further comprise one or more notches; wherein the one or more notches may be configured to allow a user to partition the tube into one or more smaller tubes for a customized length. The one or more slits may be configured to reduce a weight of the tailoring device. The one or more notches may be configured to reduce a weight of the tailoring device. The tube and the rod may be flexible. The tube may be configured to releaseably secure the rod, such that the tailoring device is reusable.

Another embodiment may be a method of tailoring a garment, the steps comprising: providing a tube and a rod; wherein the tube comprises a channel and a hollow portion; wherein the rod is configured to be inserted through the channel and into the hollow portion of the tube; wherein the rod has a diameter that is greater than an opening of the channel, such that the rod may be enclosed and secured by the tube; positioning the tube against a folded portion of a fabric; inserting a strip of the folded portion of the fabric through the channel and into the hollow portion of the tube; and securing the folded portion of the fabric into the tube by inserting the rod through the channel and into the tube while the measured portion of the fabric is within the hollow portion of the tube, such that the strip of the folded portion of the fabric is positioned in-between the tube and the rod and is firmly secured in this position. The method of tailoring a garment may further comprise the step of: turning the fabric right side out, such that the tube and the rod are hidden from view and create a tailored portion of the fabric.

It is an object to provide a simple tailoring device that allows a user to quickly, inexpensively, and efficiently tailor an article of clothing.

It is an object to provide a tailoring device that is lightweight and flexible, so as to provide comfort to the wearer.

It is an object to provide a tailoring device that is reusable.

It is an object to provide a tailoring device that permits a wearer to adjust a piece of fabric or garment to conform onto the wearer's body size and shape.

It is an object to provide a tailoring device that is not visible to anyone viewing the tailored garment on the wearer.

It is an object of the new device to remedy the deficiencies of the prior art.

Other features and advantages inherent in the tailoring device as claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF THE ILLUSTRATIVE EMBODIMENTS

Figure 1:
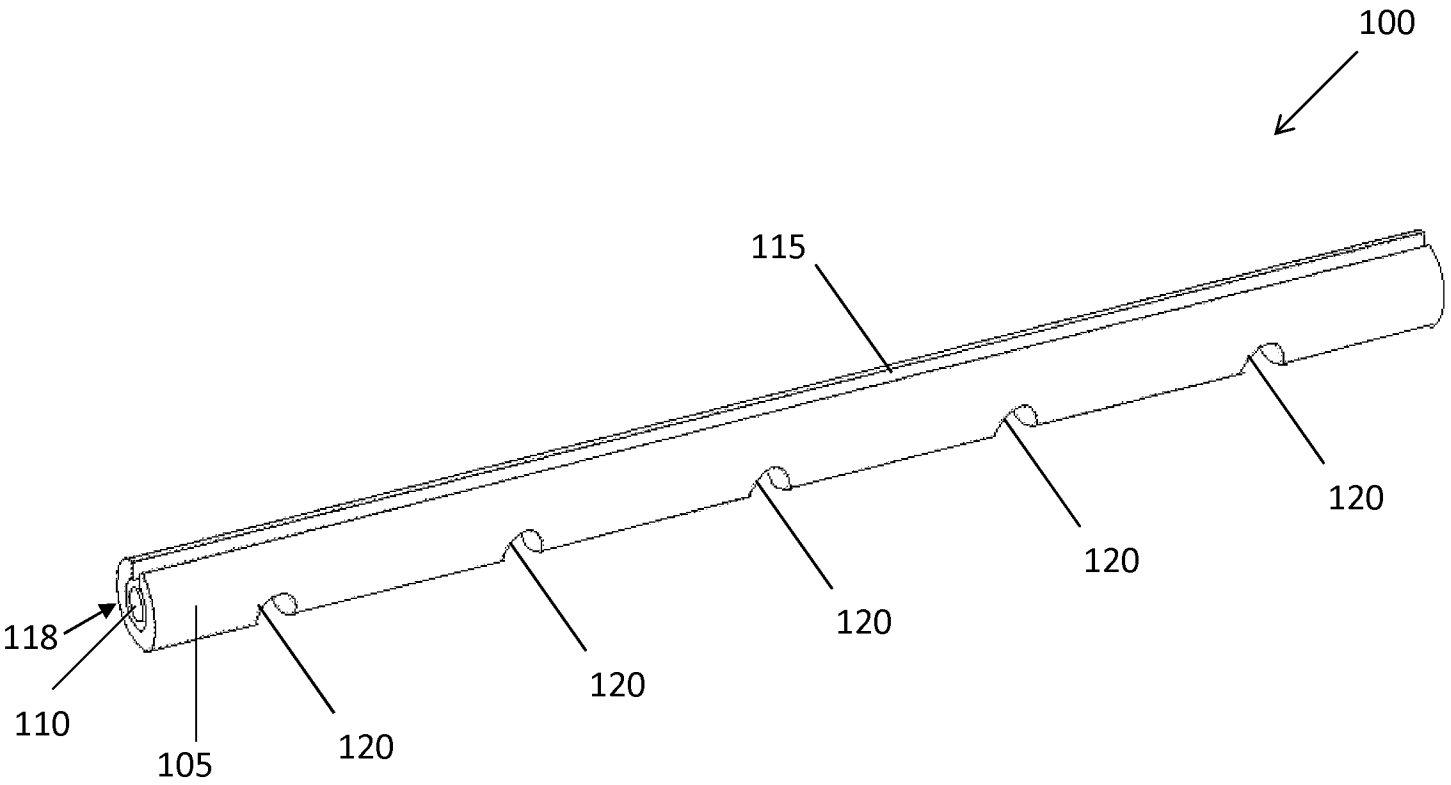
FIG. 1 is an illustration of a perspective view one embodiment of the tailoring device and shows the tube and the rod.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail in order to prevent unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the graphs, figures, and detailed descriptions thereof, are to be regarded as illustrative in nature and not restrictive. Also, the reference or non-reference to a particular embodiment of the invention shall not be interpreted to limit the scope of the invention.

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In the following description, certain terminology is used to describe certain features of one or more embodiments of the invention. The exact allowable degree of deviation from absolute completeness may in some cases depend on the specific context. However, generally speaking, the nearness of completion will have the same overall result as if absolute and total completion were obtained. The use of "substantially" is equally applicable when used in a negative connotation to refer to the complete or near complete lack of an action, characteristic, property, state, structure, item, or result.

As used herein, the terms "fabric", "garment", "cloth", and "clothing" generally refer to one or more pieces of cloth or portions of clothing, typically produced by weaving or knitting textile fibers such as articles of clothing. Examples of articles of clothing may include, without limitation, bikinis, blazers, blouses, boxers, briefs, camisoles, cardigans, cargos, coats, corsets, cravats, dresses, jackets, gloves, gowns, hats, hooded sweatshirts, jackets, jeans, lingerie, nightgowns, nightwear, overalls, pants, polo shirts, ponchos, robes, pajamas, shirts, shorts, skirts, shorts, suits, sweatshirts, swimwear, t-shirts, tailcoats, tops, tracksuits, trainers, underwear, and waistcoats. The term "fabric" may also include other cloths aside from articles of clothing such as bed sheets, tablecloths, drapes, covers, furniture covers, and the like. Thus, the terms "fabric", "garment", "cloth", and "clothing" may also include any flexible manmade and/or non-manmade material, which may include without limitation, polymers, elastomers, metals, composites, ceramics, concrete, and wood materials. Furthermore, the terms "fabric", "garment", "cloth", and "clothing" may refer to materials of any type of size or shape, such as circles, squares, rectangles, triangles, irregular shapes, and the like.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on the individual member's presentation in a common group without indications to the contrary.

FIG. 1 is an illustration of a perspective view of one embodiment of the tailoring device and shows the tube and the rod. As shown in FIG. 1, one embodiment of the tailoring device 100 may comprise: a tube 105 and rod 110. The tube 105 may comprise a channel 115, hollow portion 118 (shown more clearly in FIGS. 2, 3, 9*a-b*), and one or more slits 120. The tube 105 is generally a long, substantially hollow device that is used to hold and secure the rod 110, which, as shown, may be substantially cylindrical. The tube 105 may also be flexible and may bend (in a poseable or non-posable memory return manner) into various shapes and positions. In a preferred embodiment, the tube 105 is generally cylindrical and tubular, but may be constructed in various sizes and shapes such as triangular, rectangular, square, and the like. The tube 105 is preferably constructed of a polymer but may be manufactured with any manmade or non-manmade material. The rod 110 is generally a cylindrical and elongated object that fits past the channel 115 and into the hollow portion 118 of the tube 105. The rod 110 may have a similar length as the tube 105 and may be flexible and may bend (in a poseable or non-posable memory return manner) to conform in various shapes and positions Like the tube 105, the rod 110 is generally constructed of a polymer or other semi-flexible and light weight material, but may be manufactured with any manmade or non-manmade materials. In alternative embodiments, a cord or wire may be used as the rod 110.

FIG. 1 shows that the tube 105 may comprise a channel 115, hollow portion 118, and one or more slits 120. The channel 115 is generally a long narrow cut or opening on the tube 105 for easy access to the hollow portion 118 of the tube 105. The channel 115 may also be used for easy placement of the rod 110 by pushing the rod 110 past the channel 115 and snapping the rod 110 into the hollow portion 118 of the tube 105. In a preferred embodiment, the rod 110 may fit inside the hollow portion 118 of the tube 105, such that the rod 110 is substantially and removeable secured by the tube 105. The slits 120 are generally cuts or openings on the tube 105 and are typically configured to allow a user to more easily partition, break, or cut portions of the tube 105 into various lengths. The slits are generally oval in shape, but may be shaped in various sizes and shapes. Additionally, the slits 120 may be space evenly as shown in FIG. 1, or the slits 120 may be spaced unevenly. In an alternative embodiment, the slits 120 may be replaced with scored lines configured for easy snapping or cutting for easy customization. The slits 120 also make the tube lighter.

In an embodiment, the tube 105 may be approximately 10 to 18 inches long and 0.25 to 0.5 inches wide in diameter. The tube 105, however, may be longer or shorter based on the needs of the user, and may be configured to be adjustable in length. In one example, the user may adjust the length of the tube 105 by cutting off excess material. Similarly, the diameter of the tube 105 may be adjusted based on the needs and requirements of the user (i.e., the user inserting a cloth or fabric into the channel 115 and into the hollow portion 118 of the tube 105 may prefer a tube with smaller diameter for thin clothing or a larger diameter for thicker clothing).

The width of the channel 115 is generally between approximately 0.05 to 0.2 inches, but may also be different sizes sufficient enough to receive or removeable receive the rod 110. The hollow portion 118 of the tube 105 is generally configured to hold and secure the rod 110 and may have expansive properties to accommodate various types and thicknesses of clothing material and various thicknesses of the rod 110. In another embodiment, the diameter and thickness of the rod 110 may be larger than the hollow portion 118 the tube 105 to provide a tight fit of the rod 110 inside hollow portion 118 of the tube 105.

As shown, the slits 120 may be substantially round, circular, or ring-shaped with a radius of approximately 0.1 to 0.2 inches. However, the slits 120 may also have various shapes, sizes. Additionally, the slits 120 may be spaced evenly apart. In a preferred embodiment, the slits 120 are generally spaced apart in approximately 0.5 to 1.0 inches but may be of any size and spaced any distance apart.

Figure 2:
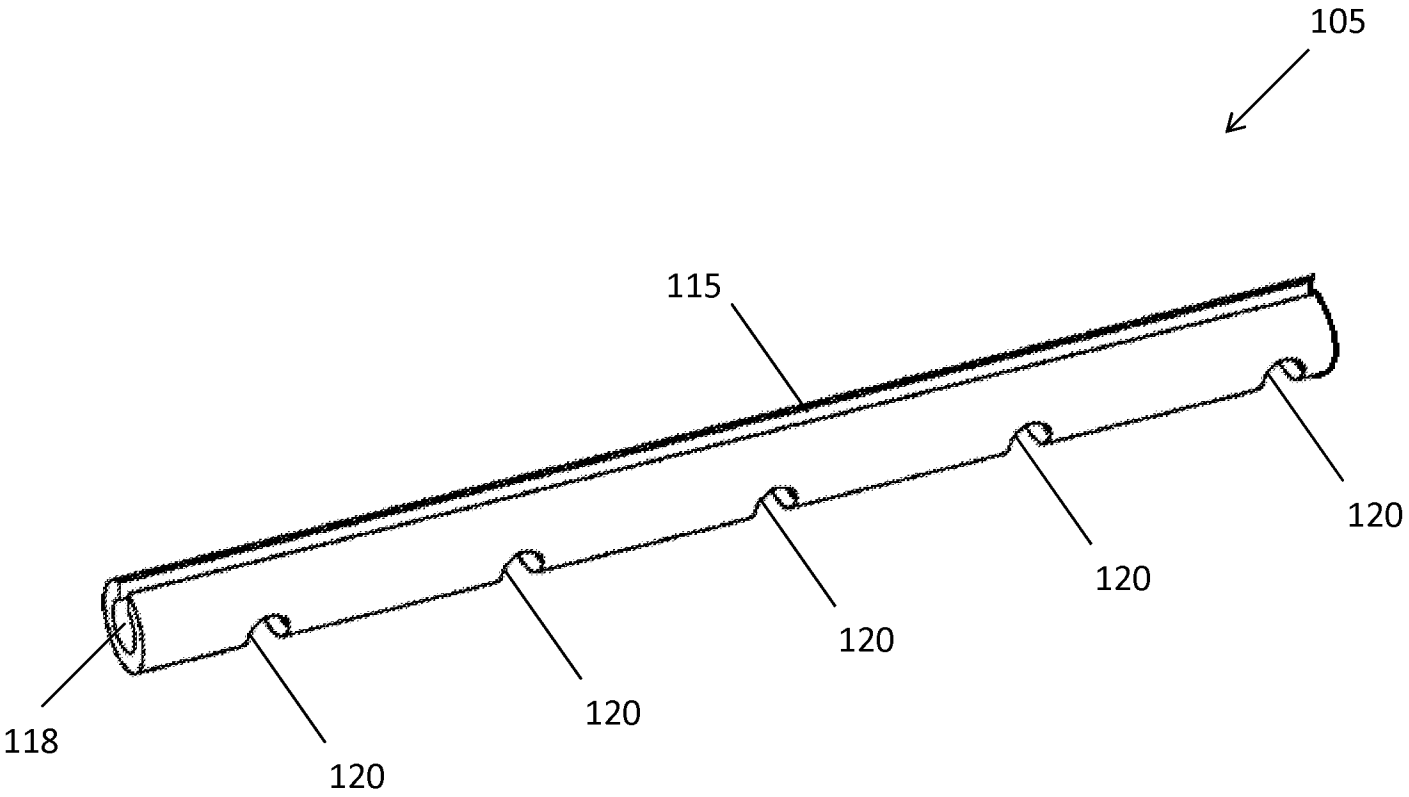
FIG. 2 is an illustration of a perspective view of one embodiment of the tube.

FIG. 2 is an illustration of a perspective view of one embodiment of the tube. As shown in FIG. 2, one embodiment of the tube 105 may comprise: a channel 115, hollow portion 118, and slits 120. As shown, the hollow portion 118 is generally an empty area or cavity that is configured to accept placement of the rod 110. The channel 115 is generally a long narrow cut or opening for easy access to the hollow portion 118 of the tube 105. The slits 120 are generally cuts or openings on the tube 105 used to allow the user to partition, break, or cut portions of the tube 105 into a customized length.

Figure 3:
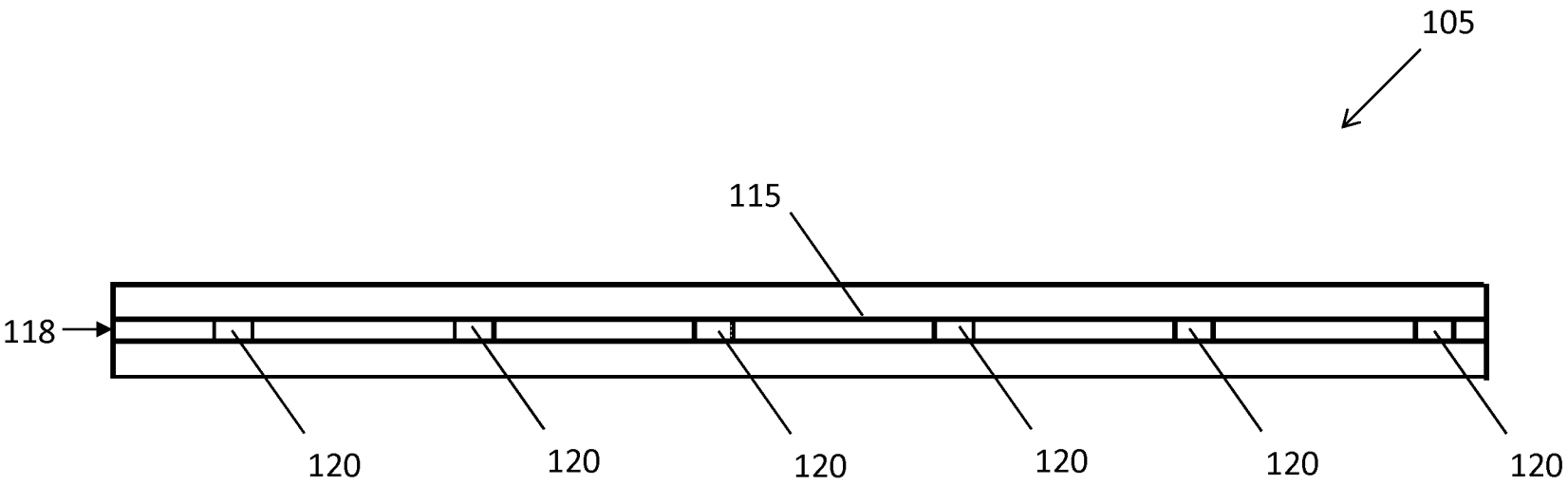
FIG. 3 is an illustration of a top plan view of one embodiment of the tube.

FIG. 3 is an illustration of a top plan view of one embodiment of the tube. As shown in FIG. 3, one embodiment of the tube 105 may comprise: a channel 115, hollow portion 118, and slits 120. FIG. 3 shows that the slits 120 located on the tube 105 may be visible through the channel 115.

Figure 4:
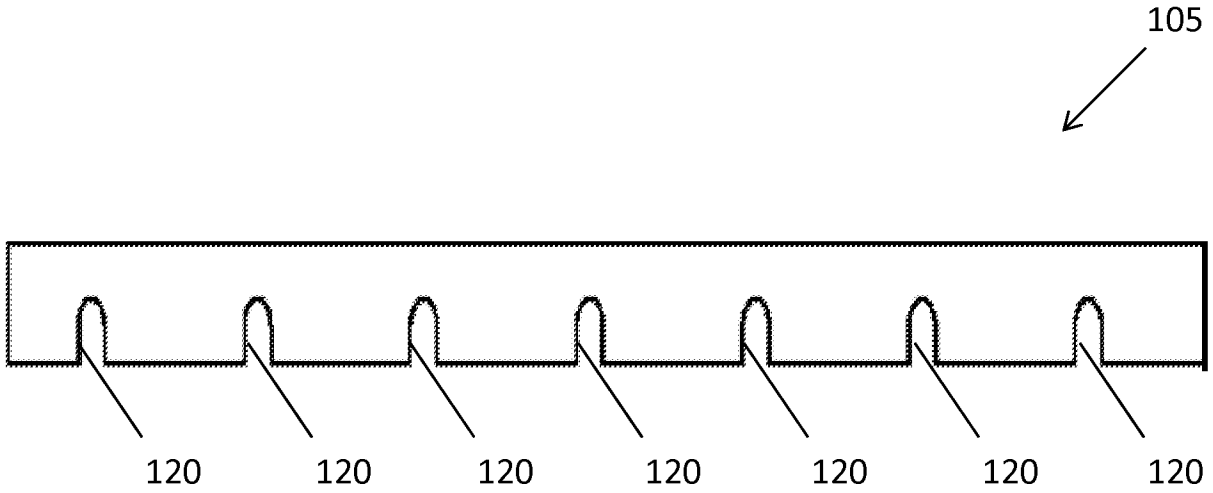
FIG. 4 is an illustration of a long side elevation view of one embodiment of the tube.

FIG. 4 is an illustration of a long side elevation view of one embodiment of the tube. As shown in FIG. 4, one embodiment of the tube 105 may comprise slits 120. FIG. 4 also shows that the slits 120 may be symmetrical and may be evenly spaced apart.

Figure 5:
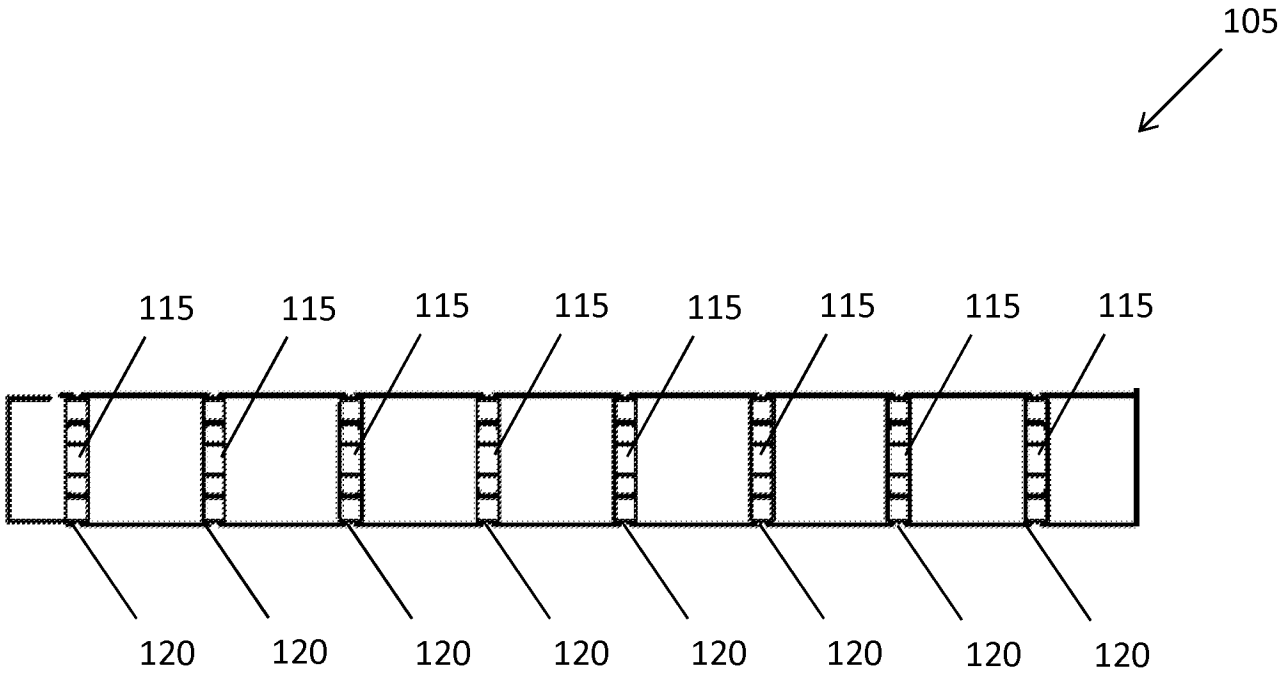
FIG. 5 is an illustration of a bottom plan view of one embodiment of the tube.

FIG. 5 is an illustration of a bottom plan view of one embodiment of the tube. As shown in FIG. 5, the tube 105 may comprise: a channel 115 and slits 120. FIG. 5 shows that, when viewing the tube 105 from the bottom perspective, portions of the channel 115 may be visible through the slits 120.

Figure 6:
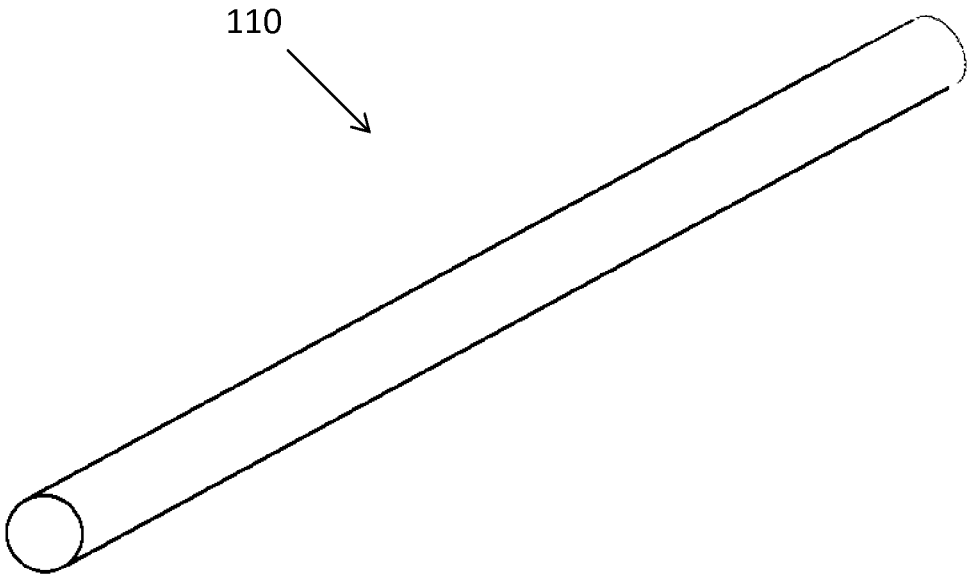
FIG. 6 is an illustration of a perspective view of one embodiment of the rod.

FIG. 6 is an illustration of a perspective view of one embodiment of the rod. As shown in FIG. 6, the rod 110 may be cylindrical in shape. The rod 110 may be solid or hollow. In an embodiment, the rod 110 may be constructed of a material that is strong, but flexible, such as polymer, polypropylene, or any other manmade or non-manmade material. The rod 110 may also be constructed in any shape that can fit, preferably matingly fit, into the hollow portion 118 of the tube 105. In one embodiment, the rod 110 may be between approximately 0.1 to 0.15 inches in thickness. In another embodiment, a cord may be used as a rod 110.

Figure 7:
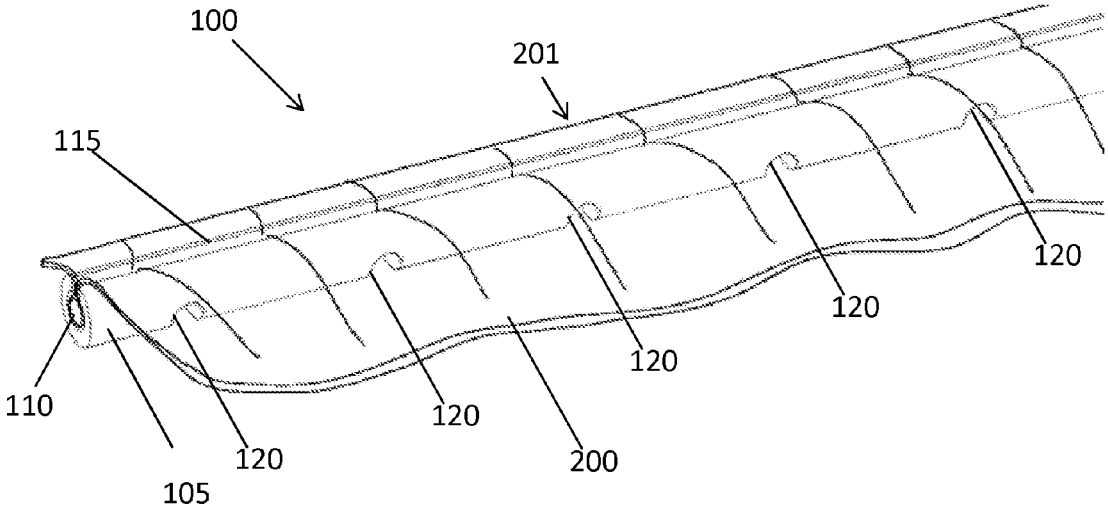
FIG. 7 is an illustration of a perspective view of another embodiment of the tailoring device and shows a piece of transparent fabric tailored and secured by the tailoring device.

FIG. 7 is an illustration of a perspective view of another embodiment of the tailoring device and shows a piece of transparent fabric tailored and secured by the tailoring device.

As shown in FIG. 7, one embodiment of the tailoring device 100 may comprise: a tube 105 and rod 110, wherein the tube 105 may further comprise: a channel 115, hollow portion 118, and slits 120. FIG. 7 also shows a fabric 200 and the folded portion 201 of the fabric 200.

FIG. 7 shows how the tailoring device 100 is used to hold and secure a piece or portion of a transparent fabric 200. Specifically, in order to tailor the measured portion of the fabric 200 with the tailoring device 100, the user initially measures how much of fabric 200 the user wishes to tailor. Using that measured portion of the fabric 200, the user generally inserts the measured portion of the fabric 200, at a pre-determined area, into the tube 105 by placing the fabric 200 over the channel 115 of the tube 105 and inserting the fabric 200 through the channel 115 and into the hollow portion 118 of the tube 105. This may be accomplished by inserting the fabric 200 through the channel 115 with a narrow yet stiff object, such as a credit card. The rod 118 is typically then forced into the tube 105 through the channel 115 and over the piece of fabric 200, such that the rod 110 holds and secures the measured portion of the fabric 200 inside the tube 105.

In one embodiment, where a user desires to tailor a shirt in approximately four inches around the waist, the user may turn the shirt inside-out, and may place the shirt on a flat surface. The user may then measure approximately one inch from the current seam on one side of the shirt (when the shirt is folded over, a single inch of measurement from the seam generally produces two inches of tailoring because the fabric is typically folded over, as shown in FIG. 7). While the shirt is still flat and inside out, the tube 105 may be placed underneath the shirt, and approximately one inch from the edge/fold with the channel 115 facing upwards. The user may then take a narrow object (e.g., credit card) and use the edge of the narrow object to force both layers of the measured portion of the shirt into the hollow portion 118 of the tube 105. Once the measured portion of the shirt has been forced into the tube 105, the rod 110 may be placed over the channel 115 and into the tube 105 along with the shirt. The rod 110 acts as a friction compress that keeps the fabric firmly in the newly tailored state. The same process may then be repeated on the other side of the shirt to make the shirt evenly tailored. As a result, the shirt is smaller around the waist for a tailored, neat, and well groomed fit. Should the user need to make additional adjustments or desires to remove the tube 105 and rod 110, the user may simply pull out the rod 110 and the shirt from the tube 105. It also may be possible to wash and dry the shirt without removing the tailoring device 100, without substantially affecting the tailoring done by the tube 105 and rod 110. Although FIG. 7 shows the tailoring device applied towards a fabric as a type of clothing, it should be understood that the tailoring device may be used towards any type of manmade or non-manmade material, such as polymers, elastomers, metals, composites, ceramics, concrete, and wood materials. Additionally, it should be understood that the tailoring device may be used with materials of any type of size or shape, such as circles, squares, rectangles, triangles, irregular shapes, and the like.

Figure 8:
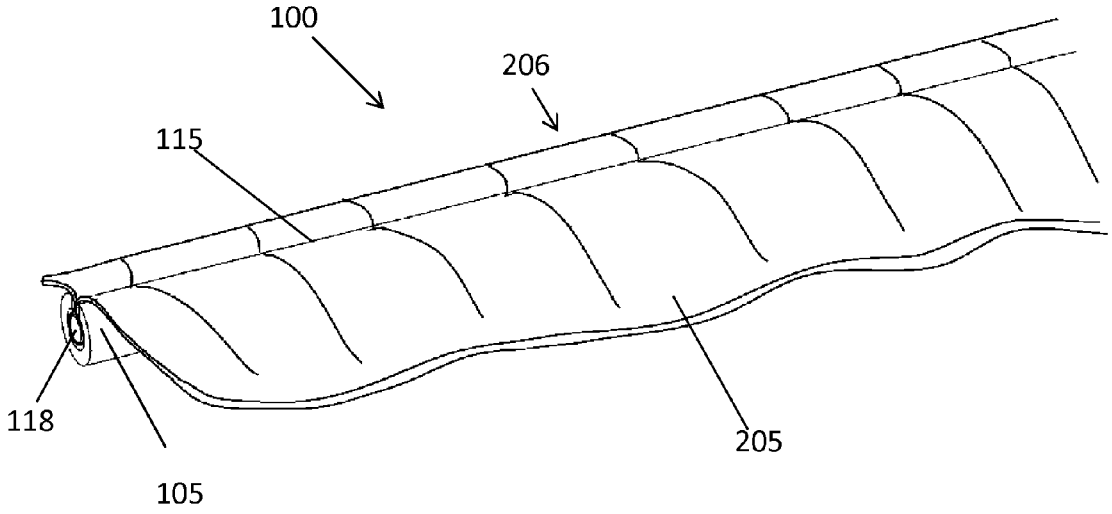
FIG. 8 is an illustration of a perspective view of another embodiment of the tailoring device and shows a piece of opaque fabric tailored and secured by the tailoring device.

FIG. 8 is an illustration of a perspective view of another embodiment of the tailoring device and shows a piece of opaque fabric tailored and secured by the tailoring device. As shown in FIG. 8, one embodiment of the tailoring device 100 may comprise: a tube 105 and rod 110. FIG. 8 also shows a fabric 205 and the folded portion 206 of the fabric 205. The tube 105 may further comprise: a channel 115, hollow portion 118, and slits 120. FIG. shows how the tailoring device 100 is used to hold and secure a piece of fabric 205. Specifically, a measured piece of fabric 205 is inserted into the channel 115 of the tube 105. The rod 110 may then be inserted through the channel 115 while overlapping the measured piece of fabric 205. By placing the rod 110 into hollow portion 118 of the tube 105 while a portion of the fabric 205 is inside the tube 105, the rod 110 may secure and fasten (preferably releasably fastened) the measured portion of fabric inside the tube 105.

Figure 9A:
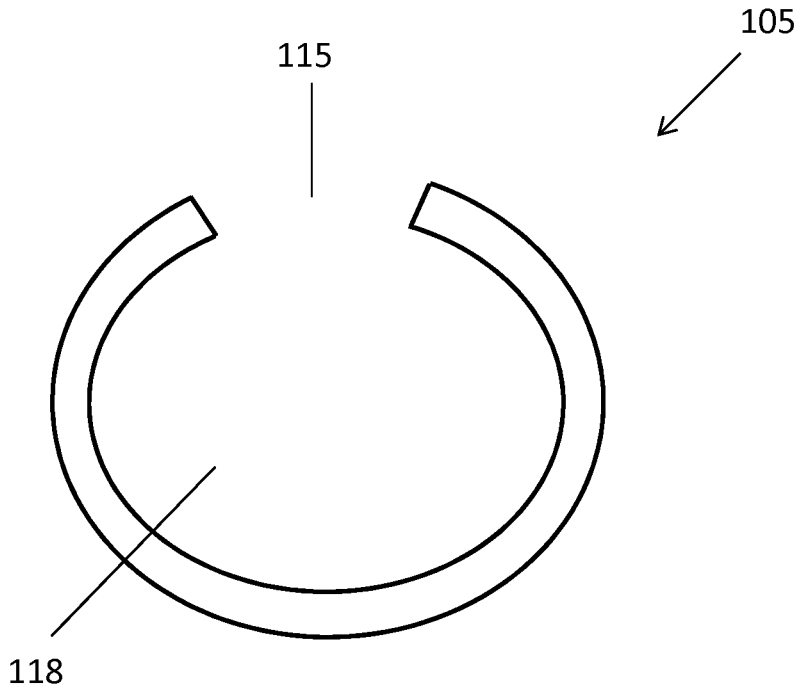
FIG. 9*a* is an illustration of a short side elevation view of one embodiment of the tube without the rod.

FIG. 9*a* is an illustration of a short side elevation view of one embodiment of the tube without the rod. As shown in FIG. 9*a*, one embodiment of the tube 105 may comprise: a hollow portion 118 and a channel 115. FIG. 9*a* shows that there may be space within the hollow portion 118 of the tube 105 and that the tube 105 may be substantially circular.

Figure 9B:
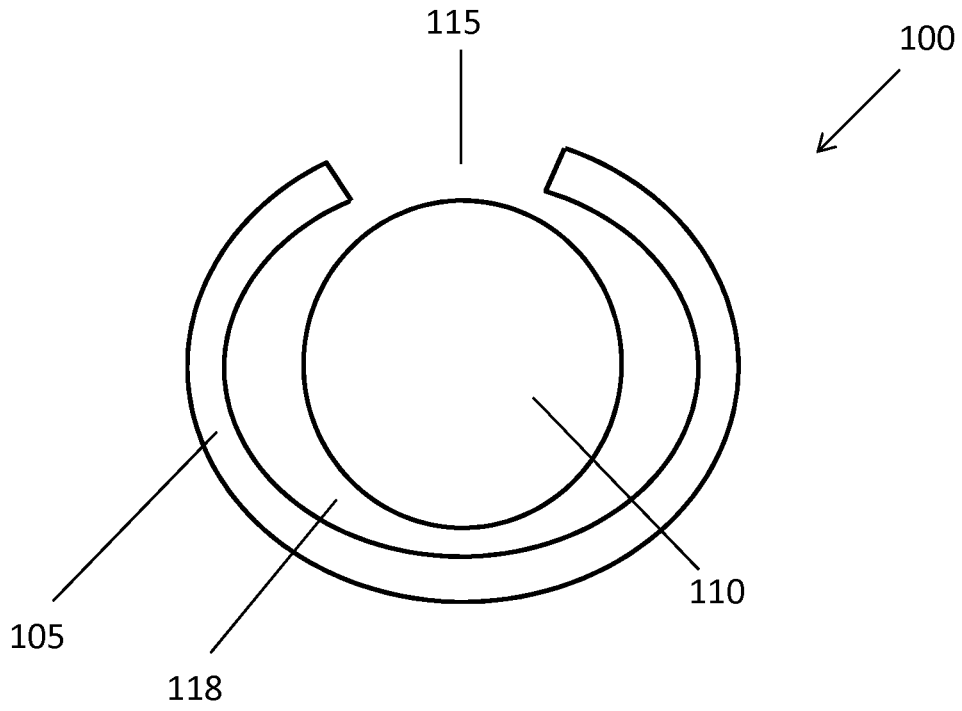
FIG. 9*b* is an illustration of a short side elevation view of one embodiment of the tube with the rod.

FIG. 9*b* is an illustration of a short side elevation view of one embodiment of the tube with the rod. As shown in FIG. 9*b*, one embodiment of the tube 105 may comprise a hollow portion 118 and a channel 115. FIG. 9*b* shows that the rod 110 may be inserted inside the hollow portion 118 of the tube 105. Fabric that is measured and needed to be tailored may be inserted between the rod 110 and tube 105. Thus, the fabric may be sandwiched in-between the rod 110 and tube 105. In an embodiment, fabric may be easily removed from the tube 105 if no rod 110 was in place in the tube 105. However, because the rod 110 generally functions as a fastener or anchor, the rod 110 may help prevent removal of the fabric. As shown in FIG. 9*b*, the rod 110 may have a diameter that is greater than the opening of channel 115, such that once the rod 110 is within the hollow portion 118, the ends of the tube 105 keep the rod firmly, but preferably releaseably in place.

Figure 10:
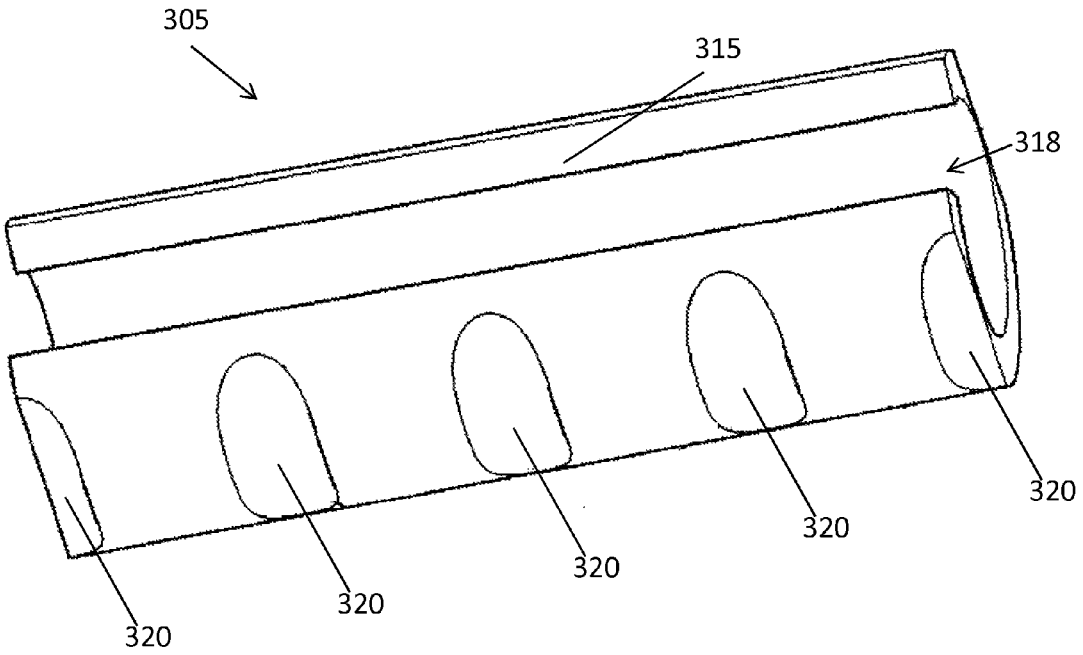
FIG. 10 is an illustration of a perspective view of another embodiment of the tube.

FIG. 10 is an illustration of a perspective view of another embodiment of the tube. As shown in FIG. 10, another embodiment of the tube 305 may comprise: a channel 315, hollow portion 318, and slits 320. FIG. 10 shows that the slits may be positioned approximately at the side of the tube 305.

Figure 11:
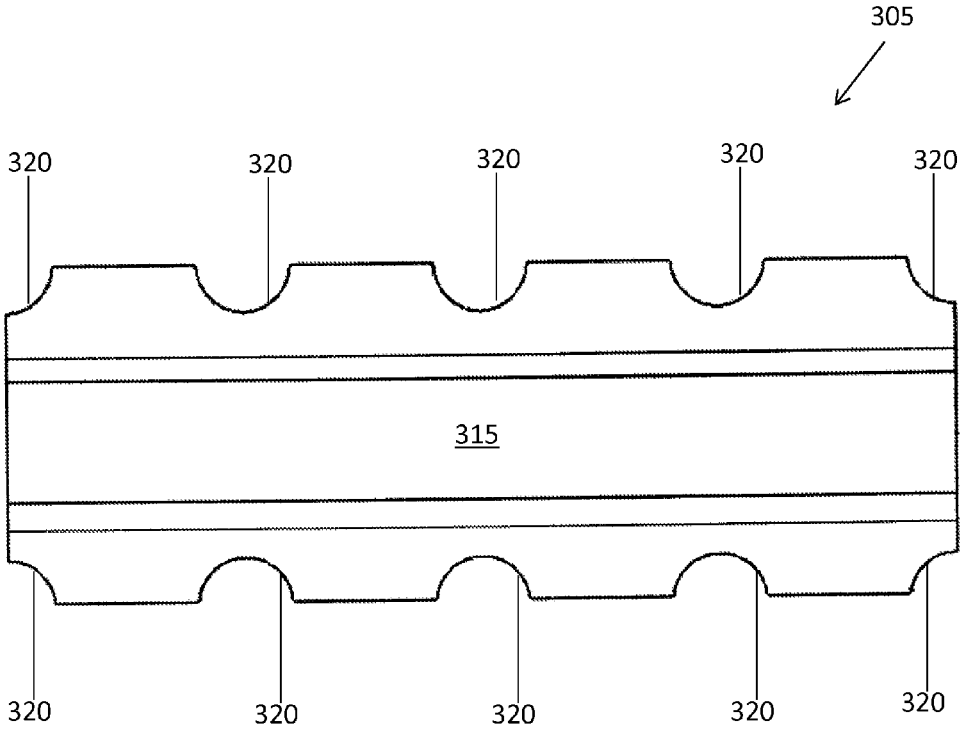
FIG. 11 is an illustration of a top plan view of another embodiment of the tube.

FIG. 11 is an illustration of a top plan view of another embodiment of the tube. As shown in FIG. 11, another embodiment of the tube 305 may comprise: a channel 315, and slits 320. Like FIG. 10, FIG. 11 shows that the slits may be positioned approximately at the side of the tube 305.

Figure 12:
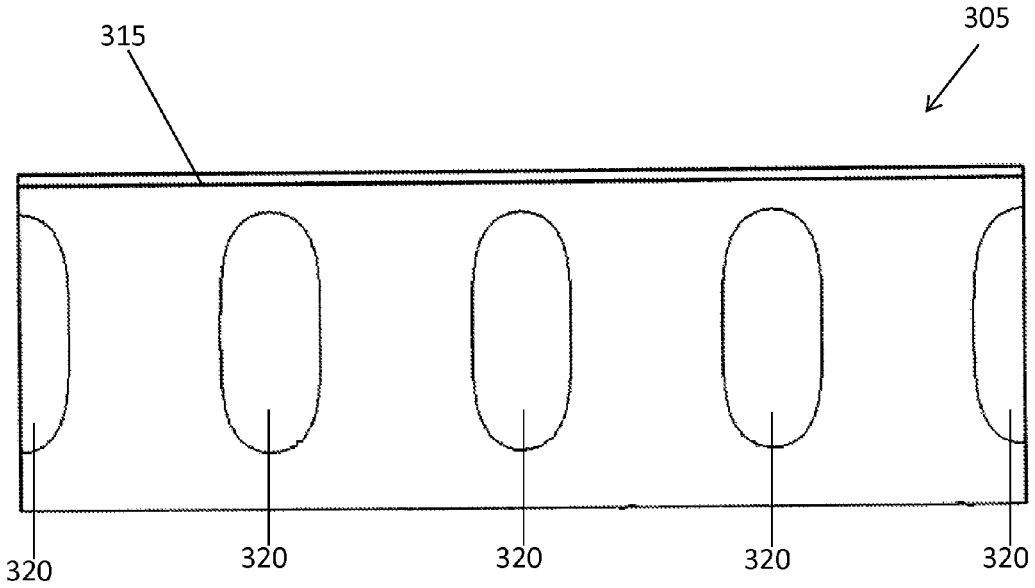
FIG. 12 is an illustration of a side elevational view of another embodiment of the tube.

FIG. 12 is an illustration of a side elevational view of another embodiment of the tube. As shown in FIG. 12, another embodiment of the tube 305 may comprise: a channel 315 and notches 320. Like FIGS. 10 and 11, FIG. 12 shows that the tube may have notches 320 instead of slits and that these notches 320 may be positioned approximately at the side of the tube 305. As shown, the notches 320, unlike the slits, may not go all the way through the tube 305. The notches 320, similar to the slits, reduces the weight of the tube 305 and may allow a user to more easily partition, break, or cut portions of the tube 305 into various lengths.

Figure 13:
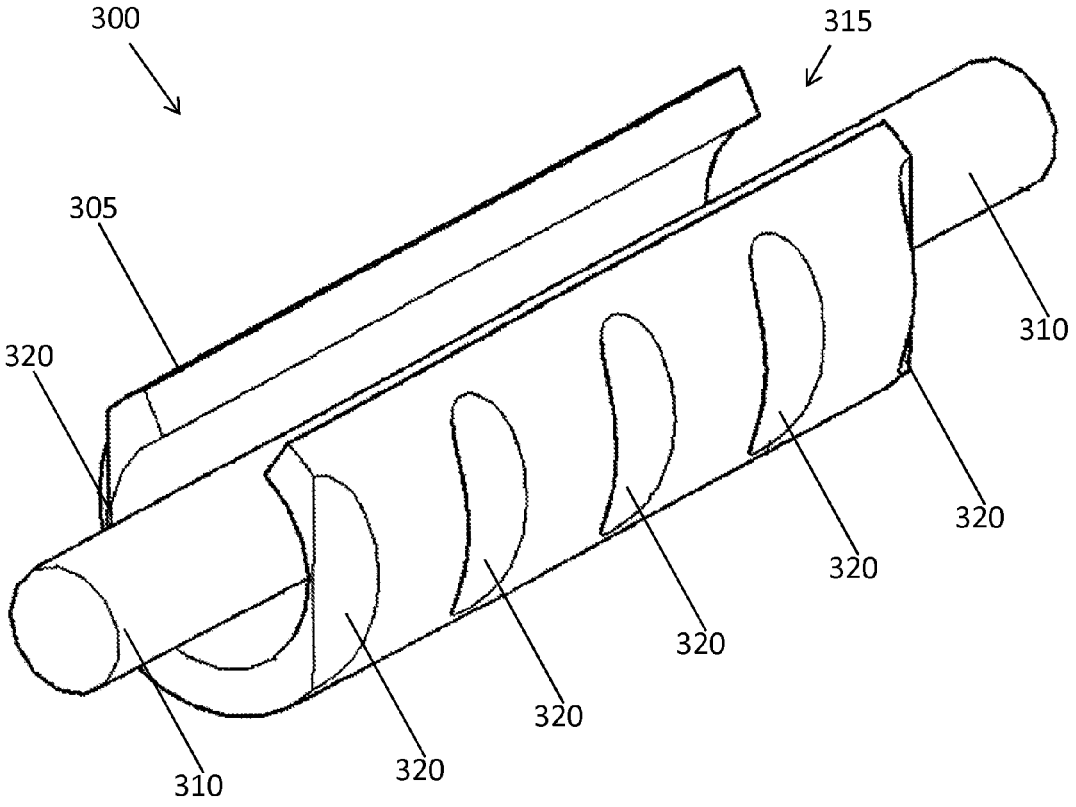
FIG. 13 is an illustration of a perspective view of another embodiment of the tailoring device showing the tube and the rod.

FIG. 13 is an illustration of another embodiment of the tailoring device. As shown in FIG. 13, another embodiment of the tailoring device 300 may comprise: a tube 305 and rod 310. The tube 305 may comprise a channel 315, hollow portion 318, and one or more notches 320. FIG. 13 shows that the notches 320 may be positioned approximately at the side of the tube 305.

Figure 14:
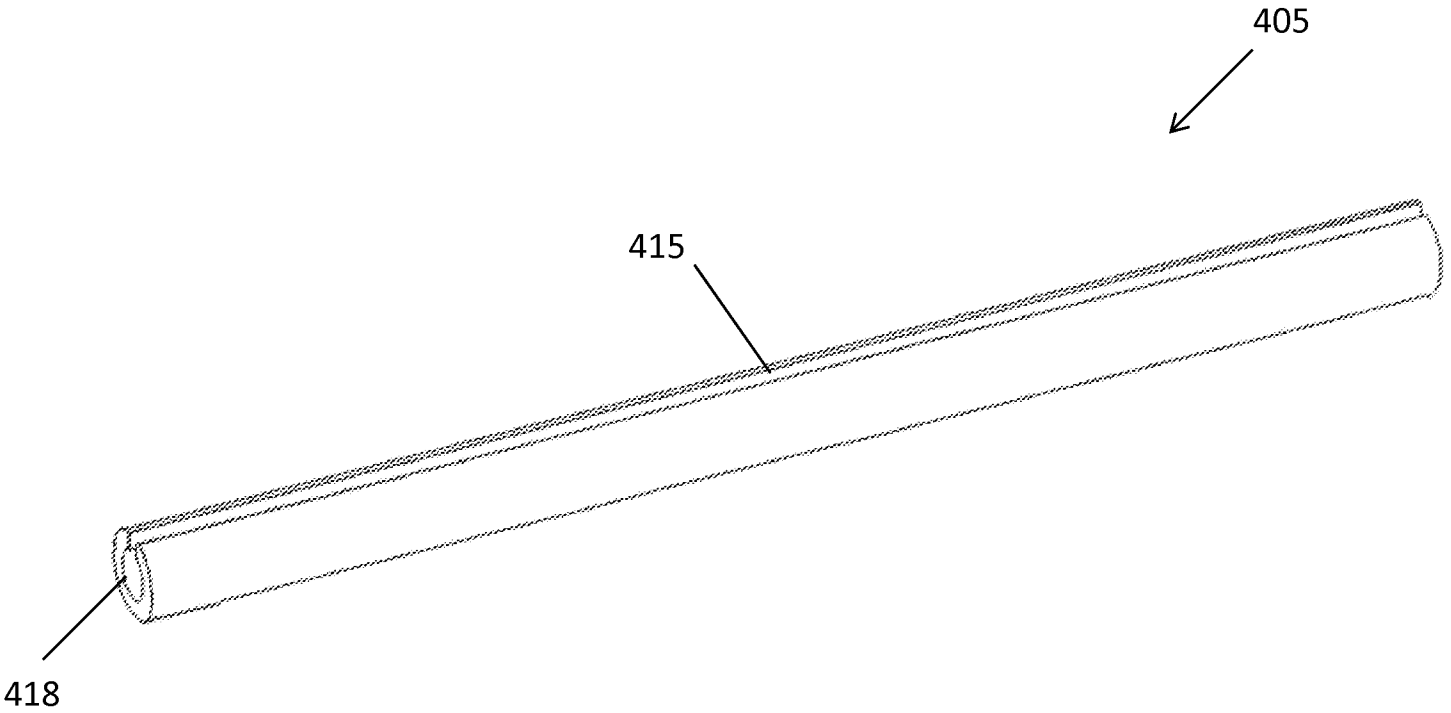
FIG. 14 is an illustration of a perspective view of another embodiment of the tube without notches or slits.

FIG. 14 is an illustration of a perspective view of another embodiment of the tube without notches or slits. As shown in FIG. 14, another embodiment of the tube 405 may comprise a channel 415 and hollow portion 418. FIG. 14 also shows that the tube 405 may lack notches.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

The invention claimed is:

1. A tailoring device comprising:

a tube; and a rod;

wherein said tube comprises a channel and a hollow portion;

wherein said rod is configured to be inserted through said channel and into said hollow portion of said tube;

wherein said rod has a diameter that is greater than an opening of said channel, such that said rod may be enclosed and secured by said tube; and wherein said tube is configured to accept a measured portion of a fabric past said channel and into said hollow portion of said tube and wherein said rod is configured to be put into said hollow portion of said tube over said measured portion of said fabric, such that said rod secures said measured portion of said fabric into said hollow portion of said tube.

2. The tailoring device of claim 1, wherein said tube further comprises one or more slits;

wherein said one or more slits are configured to allow a user to partition said tube into one or more smaller tubes for a customized length.

3. The tailoring device of claim 1, wherein said tube further comprises one or more notches;

wherein said one or more notches are configured to allow a user to partition said tube into one or more smaller tubes for a customized length.

4. The tailoring device of claim 2, wherein said one or more slits are configured to reduce a weight of said tailoring device.

5. The tailoring device of claim 3, wherein said one or more notches are configured to reduce a weight of said tailoring device.

6. The tailoring device of claim 1, wherein said tube and said rod are flexible.

7. The tailoring device of claim 1, wherein said tube is configured to releaseably secure said rod, such that said tailoring device is reusable.

8. A tailoring device comprising:

a tube; and a rod;

wherein said tube comprises a channel and a hollow portion;

wherein said rod is configured to be inserted through said channel and into said hollow portion of said tube;

wherein said rod has a diameter that is greater than an opening of said channel, such that said rod may be enclosed and secured by said tube; and wherein said tube is configured to accept a measured portion of a shirt past said channel and into said hollow portion of said tube and wherein said rod is configured to be put into said hollow portion of said tube over said measured portion of said shirt, such that said rod secures said measured portion of said shirt into said hollow portion of said tube.

9. The tailoring device of claim 8, wherein said tube further comprises one or more slits;

wherein said one or more slits are configured to allow a user to partition said tube into one or more smaller tubes for a customized length.

10. The tailoring device of claim 8, wherein said tube further comprises one or more notches;

wherein said one or more notches are configured to allow a user to partition said tube into one or more smaller tubes for a customized length.

11. The tailoring device of claim 9, wherein said one or more slits are configured to reduce a weight of said tailoring device.

12. The tailoring device of claim 10, wherein said one or more notches are configured to reduce a weight of said tailoring device.

13. The tailoring device of claim 8, wherein said tube and said rod are flexible.

14. The tailoring device of claim 8, wherein said tube is configured to releaseably secure said rod, such that said tailoring device is reusable.

15. A method of tailoring a garment, the steps comprising:

providing a tube and a rod;

wherein said tube comprises a channel and a hollow portion;

wherein said rod is configured to be inserted through said channel and into said hollow portion of said tube;

wherein said rod has a diameter that is greater than an opening of said channel, such that said rod may be enclosed and secured by said tube;

positioning said tube against a folded portion of a fabric;

inserting a strip of said folded portion of said fabric through said channel and into said hollow portion of said tube; and securing said folded portion of said fabric into said tube by inserting said rod through said channel and into said tube while said measured portion of said fabric is within said hollow portion of said tube, such that said strip of said folded portion of said fabric is positioned in-between said tube and said rod and is firmly secured in this position.

16. The method of tailoring a garment of claim 15, further comprising the steps:

turning said fabric right side out, such that said tube and said rod are hidden from view and create a tailored portion of said fabric.

* * * * *